US005137037A

United States Patent [19]

Mochizuki

[11] Patent Number: 5,137,037

[45] Date of Patent: Aug. 11, 1992

[54] REVERSIBLE ANCHORING MEMBER FOR HEAD ORNAMENTAL ARTICLE

[75] Inventor: Kousuke Mochizuki, Tokyo, Japan

[73] Assignee: Aderans Co., Ltd., Tokyo, Japan

[21] Appl. No.: 550,035

[22] Filed: Jul. 9, 1990

[51] Int. Cl.[5] ..... A61G 3/00

[52] U.S. Cl. ..... 132/53

[58] Field of Search ..... 132/53, 55, 56, 201, 132/275; 24/530, 561

[56] References Cited

U.S. PATENT DOCUMENTS

| | | | |
|---|---|---|---|
| 3,645,280 | 2/1972 | Cutler et al. | 132/53 |
| 3,699,978 | 10/1972 | Holly | 132/53 |
| 4,011,639 | 3/1977 | Koleske | 24/561 |
| 4,155,370 | 5/1979 | Nemoto | 132/53 |
| 4,168,713 | 9/1979 | Agiotis | 132/53 |

FOREIGN PATENT DOCUMENTS

| | | | |
|---|---|---|---|
| 0627676 | 9/1927 | France | 132/55 |
| 0276919 | 9/1927 | United Kingdom | 132/53 |
| 1536630 | 12/1978 | United Kingdom | 132/53 |

*Primary Examiner*—John J. Wilson
*Assistant Examiner*—Jeffrey A. Smith
*Attorney, Agent, or Firm*—Nixon & Vanderhye

[57] ABSTRACT

In an anchoring member for a head ornamental article, a plurality of pectinate projections are mounted to a curved reverisble element in spaced relation to each other. A gripping arrangement is provided on the curved reversible element or on a wig base. The pectinate projections are capable of being engaged with and disengaged from the gripping arrangement when the curved reversible element is reversed. Engagement of the pectinate projections and the gripping arrangement with each other at the time the curved reversible element is reversed enables the pectinate projections and the gripping element to cooperate with each other to clamp therebetween an article being clamped. A hooking element is mounted to the curved reversible element, and is capable of being engaged with a caught unit on the head ornamental article so that the curved reversible element can detachably be fastened to the heat ornamental article. A wig is also disclosed which comprises at least one anchoring member.

35 Claims, 11 Drawing Sheets

REVERSIBLE ANCHORING MEMBER FOR HEAD ORNAMENTAL ARTICLE

BACKGROUND OF THE INVENTION

The present invention relates to an anchoring member mounted to a head ornamental article such as, for example, a wig, ornamentation for a head and so on, for fastening the head ornamental article to a suitable article such as hairs, and also to a wig having at least one anchoring member.

It will be considered to mount, for instance, a wig or the like to a user's or wearer's head. In this case, if hairs on the head are clamped by at least one anchoring member for fixedly mounting the wig to the user's head, which is mounted along an inner periphery of a wig base, it is easy to mount and demount the wig to and from the user's head.

The anchoring member and the wig using the same, described above, have conventionally been known from, for example, Japanese patent Publication No. SHO 54-16785 which has been filed in the name of the same assignee and which corresponds to U.S. Pat. No. 4,155,370 or U.K. Patent No. 1 536 630.

The anchoring member of the kind referred to above comprises a curved reversible element having reversible performance and a plurality of pectinate projections mounted to the reversible element. In interlocking relation to reversion of the reversible element, the pectinate projections are flexed to clamp the hairs between the pectinate projections and gripping means on one of the reversible element and an inner surface of a wig base.

The anchoring member described above is mounted, at an optical position, to the inner surface of the wig base which is made of a synthetic resinous material and/or a net element, by the use of sewing threads of adhesives.

By the way, a case will be considered where the anchoring member is mounted to the wig base by the use of the sewing threads or the adhesives. In this case, when the anchoring member is broken so that it is required to replace the anchoring member by a new one, the following various problems arise.

Specifically, a case will be considered where the anchoring member is fixedly mounted, by, for example, adhesives, to the wig base which is made of cloth and/or a resinous material. In this case, if an attempt is made to demount the anchoring member from the wig base by the use of a parting agent such as acetone or the like, there is such a fear that the wig base made of the cloth and/or the synthetic resinous material is partially melted or dissolved. Further, in the case where the anchoring member is mounted to the wig base made of, for example, a net by the sewing threads by means of a knife or the like damages the net of the wig base.

Particularly, if the anchoring member is fixedly mounted to the wig base by the sewing threads, it will be required that, after the sewing threads have been cut to demount the anchoring member from the wig base, the anchoring member is replaced by a new one, and the new anchoring member is again sewed and mounted to the wig base. Such operations damage the wig base and, in its turn, there occurs such a fear that the wig is rendered unusable. Further, loosening tends to occur in the threads by which the anchoring member is fixedly mounted to wig base, so that it is impossible to secure that the anchoring member is fixedly mounted to the wig base. Thus, the wearing state or condition of the wig is rendered unstable.

Furthermore, in the case of ornamentation for being fastened to user's hairs, which includes a ribbon, a flower, an insect or other various ornamental articles, formed by a metallic material, a plastic material or the like, normally a single anchoring member for mounting the ornamentation to the hairs is fixedly mounted to a rear side of the ornamentation. In the ornamentation of the kind referred to above, since the anchoring member is not demountable from the ornamentation, breakage of the anchoring member during use for several times renders the ornamentation, per se, for being fastened to the hairs, unusable.

SUMMARY OF THE INVENTION

It is an object of the invention to provide an anchoring member in which, if breakage or the like requires replacement of the anchoring member by a new one, the new anchoring member can be easily be fastened to a hard ornamental article without damage of a body of the same such as a wig base, and in which the anchoring member can easily be demounted from other various ornamental articles for being fastened to user's hairs.

It is another object of the invention to provide a wig in which the anchoring member described above can easily be mounted to or demounted from a wig base.

For the above purpose, according to the invention, there is provided an anchoring member for a head ornamental article, comprising:

a curved reversible element having reversible performance;

a plurality of pectinate projection mounted to the curved reversible element in spaced relation to each other;

gripping means on one of the curved reversible element and the head ornamental article, the pectinate projections being capable of being engaged with and disengaged from the gripping means when the curved reversible element is reversed;

wherein engagement of the pectinate projections and the gripping means with each other at the time the curved reversible element is reversed enables the pectinate projections and the gripping means to cooperate with each other to clamp therebetween an article being clamped;

caught means capable of being mounted to the head ornamental article; and hooking means mounted to the curved reversible element and capable of being engaged with the caught means on the head ornamental article so that the curved reversible element can detachably be fastened to the head ornamental article.

With the above arrangement of the invention, the hooking means is mounted to the curved reversible element of the anchoring member, and the anchoring member can easily be mounted fixedly to the head ornamental article by engagement of the hooking means on the curved reversible element and the caught means on the head ornamental article with each other. Further, disengagement of the hooking means on the curved reversible element and the caught means on the head ornamental article from each other easily demounts the anchoring member from the head ornamental article. Thus, in the case where the anchoring member is broken, it is possible to replace only the anchoring member by a new one, without damage of the head ornamental article which is high in cost.

According to the invention, there is also provided a wig characterized by comprising:

a wig base mainly composed of a net element and/or an artificial skin;

a plurality of hairs planted to an outer surface of the wig base;

at least one anchoring member mounted to an inner surface of the wig base;

caught means fixedly mounted to the inner surface of the wig base at a location where the anchoring member is to be mounted to the inner surface of the wig base; and wherein the anchoring member comprises a curved reversible element having reversible performance, a plurality of pectinate projections mounted to the curved reversible element in spaced relation to each other, and hooking means mounted to the curved reversible element and capable of being engaged with the caught means on the inner surface of the wig base so that the curved reversible element can detachably be fastened to the inner surface of the wig base, and gripping means on one of the curved reversible element and the wig base, the pectinate projections being capable of being engaged with and disengaged from the gripping means when the curved reversible element is reversed, and wherein engagement of the pectinate projections and the gripping means with each other at the time the curved reversible element is reversed when the wig is worn on a user's head enables the pectinate projections and the gripping means to cooperate with each other to clamp therebetween hairs on the user's head.

With the above arrangement of the invention, the hooking means is mounted to the curved reversible element of the anchoring member, and the anchoring member can easily be mounted fixedly to the wig by engagement of the hooking means on the curved reversible element and the caught means on the inner surface of the wig base with each other. Further, disengagement of the hooking means on the curved reversible element and the caught means on the inner surface of the wig base from each other easily demounts the anchoring member from the wig base. Thus, there are obtained the following practical advantages. That is, even if the anchoring member is broken, it is possible to easily replace the anchoring member by a new one. Further, when the wig is washed or the like, previous demounting of the anchoring member enables the washing not to rust the anchoring member, so that it is possible to use the anchoring member for a long period of time.

DETAILED DESCRIPTION

Figure 1:
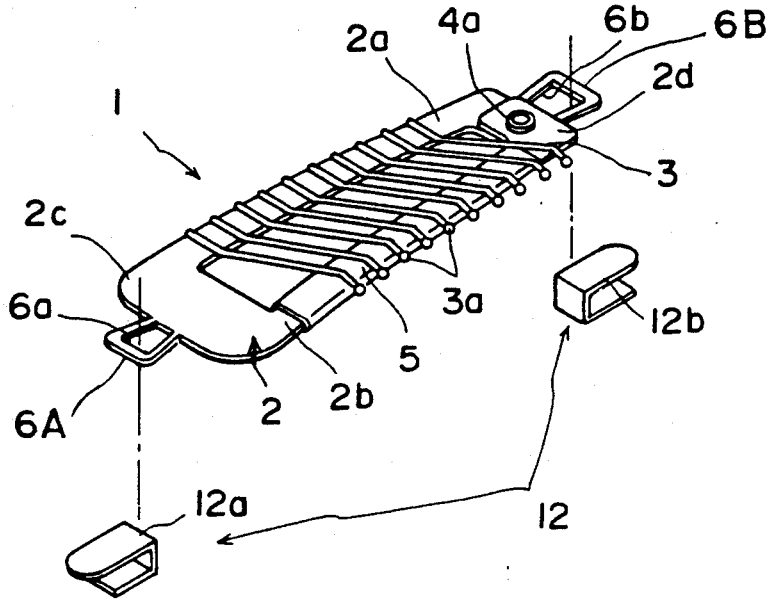
FIG. 1 is a perspective view showing an anchoring member according to a first embodiment of the invention.

Various embodiments of the invention and modifications thereof will be described below with reference to the drawings. It should be noted that like or similar components and parts are designated by the same or like reference numerals throughout the drawings, and the description of the like or similar components and parts will be simplified or omitted to avoid repetition.

FIRST EMBODIMENT

Referring first to FIG. 1, there is shown, in a perspective view, an anchoring member 1 according to a first embodiment of the invention. The anchoring member 1 comprises a curved reversible element 2 having reversible performance, a plurality of pectinate projections 3 mounted to the curved reversible element 2 in equidistantly spaced relation to each other, and a gripping element 5 provided on the curved reversible element 2. The gripping element 5 may be a rubber tube or pipe having high frictional resistance. The pectinate projections 3 are capable of being in contact with and out of contact with the gripping element 5 when the curved reversible element 2 is reversed. Specifically, the curved reversible element 2 has a pair of legs 2*a* and 2*b*, and is elongated in configuration having both longitudinal ends 2*c* and 2*d*. The pectinate projections 3 have their respective proximal ends which are fusibly deposited on the leg 2*a* in equidistantly spaced relation to each other. The leg 2*b* is covered with the gripping element 5 which is made of a rubber tube or pipe, in order to enable the coefficient of friction of the leg 2*b* to increase with respect to the pectinate projections 3.

The curved reversible element 2 is formed in the following manner. That is, a sheet having resiliency or elasticity such as, for example, a metallic sheet is before hand formed into a U-shaped configuration having the pair of legs 2*a* and 2*b*. The legs 2*a* and 2*b* have their respective free ends which are pulled toward each other and which are superimposed upon each other. Subsequently, the free ends of the respective legs 2*a* and 2*b* are connected to each other by an eyelet 4*a*. By doing so, the legs 2*a* and 2*b* are bent into an arcuate and configuration in the same direction, to give the reversible performance to the curved reversible element 2.

The pectinate projections 3 are made of, for example, a plurality of metallic thin wires which have their respective proximal ends and forward ends. The proximal ends of the respective wires are fusibly deposited on an upper face of one of the pair of legs 2*a* of the curved reversible element 2 in equidistantly spaced relation to each other. The vicinity of the forward ends of the respective wires extends beyond and is bent toward the other leg 2*b* of the curved reversible element 2. The pectinate projections 3 have their respective bulges 3*a* which are formed respectively at the forward ends of the respective pectinate projections 3, so that if the pectinate projections 3 are in contact with a user's head skin, the latter is prevented from being injured by the pectinate projections 3.

In connection with the above, the gripping element 5 may be formed by the other leg 2*b* per se. That is, the gripping element 5 may be dispensed with, if the surface of the other leg 2*b* has high frictional resistance with respect to the pectinate projections 3.

Further, the anchoring member 1 has a latching or hooking element mounted to the curved reversible element 2 so as to be engageable with a caught unit which is provided on, for example, an inner surface of a wig base subsequently to be described. The hooking element on the curved reversible element 2 comprises a pair of hooking sections 6A and 6B which are capable of being engaged respectively with a pair of caught elements of the caught unit on the wig base so that the curved reversible element 2 can detachably be fastened to the wig base. In the first embodiment illustrated in FIG. 1, the pair of hooking sections 6A and 6B are formed therein respectively with a pair of hooking bores 6*a* and 6*b*. The hooking sections 6A and 6B are so provided as to project outwardly respectively from the longitudinal ends 2*c* and 2*d* of the curved reversible element 2.

Figure 2:
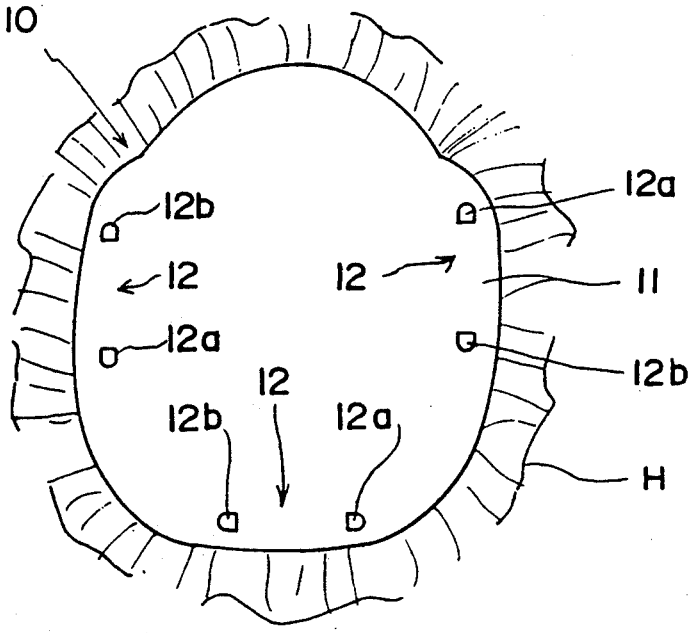
FIG. 2 is a bottom view showing an inner surface of a wig.

The anchoring member 1 according to the first embodiment of the invention is constructed as described above. The anchoring member 1 is mounted to, for example, an inner surface of a wig base 11 of a wig 10 as illustrated in FIG. 2 which is a bottom view showing an inner surface of the wig 10.

Specifically, the wig 10 including a toupee comprises the wig base 11 made of a net, cloth and/or an artificial skin and principally formed in accordance with a user's head configuration, and a plurality of hairs H planted to a front or outer surface of the wig base 11. Further, a plurality of caught units 12 are arranged at their respective desirable locations on a periphery of a rear of inner surface of the wig base 11.

Referring again to FIG. 1, each of the caught units 12 on the inner surface of the wig base 11 includes a pair of spaced caught elements 12*a* and 12*b* having their respective L-shaped or C-shaped cross-sectional configurations whose respective openings are directed away from each other. The caught elements 12*a* and 12*b* are mounted at their respective positions on the peripheral edge of the wig base 11 such that the pair of caught elements 12*a* and 12*b* have a spacing therebetween which is substantially identical with that between the pair of hooking bores 6*a* and 6*b* of the respective hooking sections 6A and 6B.

Figure 3:
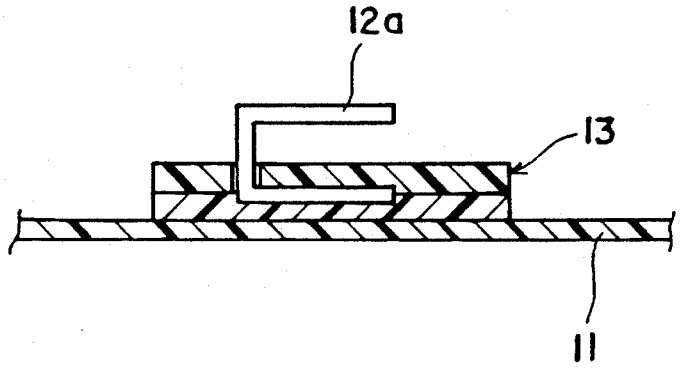
FIG. 3 is a fragmentary enlarged cross-sectional view showing one of caught elements of each of a plurality of caught units, which are mounted to an inner surface of a wig base of the wig illustrated in FIG. 2.

When the caught elements 12*a* and 12*b* are mounted to the wig base 11, the bottoms of the respective caught elements 12*a* and 12*b* may directly be bonded to the wig base 11 by adhesives, or may be sewn to the wig base 11 by sewing threads. Alternatively, as shown in FIG. 3, the arrangement may be such that one of a plurality of pairs of adhesive holders 13 made of a resinous material is adhered to the inner surface of the wig base 11, and a corresponding one of the caught elements 12*a* has its bottom which is embedded in the adhesive holder 13.

Figure 4:
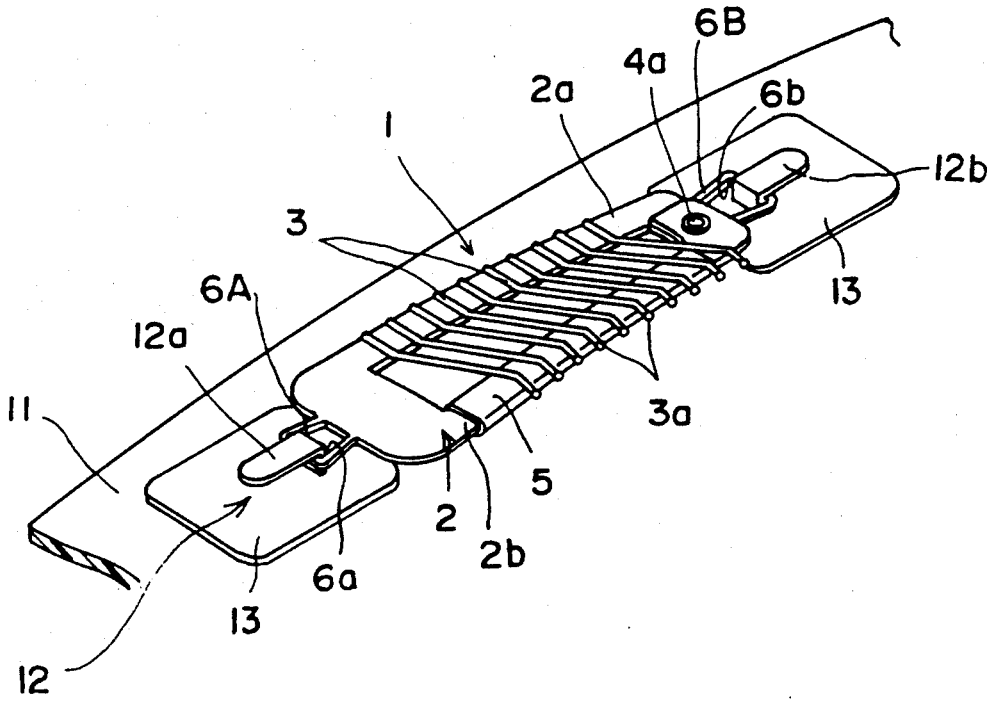
FIG. 4 is a fragmentary perspective view showing the anchoring member illustrated in FIG. 1, which is mounted to the inner surface of the wig base.

As shown in FIG. 4, when the anchoring member 1 is mounted to the wig base 11, resiliency of elasticity of the wig base 11 is utilized to insert the caught elements 12*a* and 12*b* respectively in the hooking bores 6*a* and 6*b* of the respective hooking sections 6A and 6B, so that the curved reversible element 2 is engaged with and fixedly mounted to the caught unit 12 on the inner surface of the wig base 11. Further, when the anchoring member 1 is demounted from the wig base 11, the caught element 12*a* and 12*b* are disengaged respectively from the hooking bores 6*a* and 6*b* of the respective hooking sections 6A and 6B. By doing so, engagement of the curved reversible element 2 and the wig base 11 with each other can easily be released.

Thus, it is possible to easily engage and disengaged the anchoring member 1 and the wig base 11 of the wig 10 with and from each other. Even if the anchoring member 1 is broken, it is possible to easily replace the anchoring member 1 by a new one. Moreover, since the anchoring member 1 is fixedly mounted to the wig base 11 under the hooking or engaging state or condition without the use of the adhesives or sewing threads unlike the conventional anchoring member, there is no such a fear that, when the anchoring member 1 is demounted from the wig base 11, the latter is damaged by a knife or the like.

In connection with the above, it is not necessarily required that the hooking sections 6A and 6B of the curved reversible element 2 are provided respectively at the longitudinal ends 2c and 2d of the curved reversible element 2. Three or more hooking sections may be provided at their respective locations which are suitable in engagement with each of the engaging units 12 of the wig base 11.

FIRST MODIFICATION OF FIRST EMBODIMENT

Figure 5:
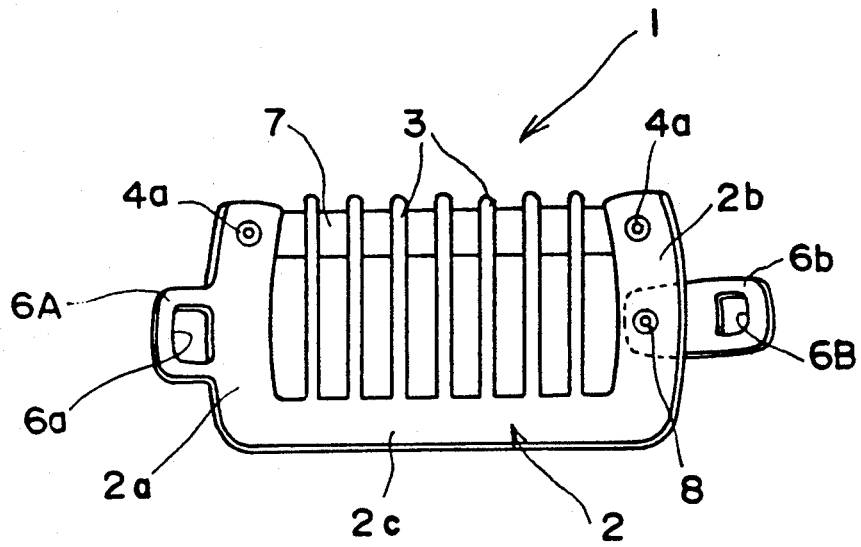
FIG. 5 is a view similar to FIG. 1, but showing a first modification of the first embodiment illustrated in FIG. 1.

The pectinate projections 3 may be formed in an integral manner with respect to the curved reversible element 2 as shown in FIG. 5. That is, the anchoring member 1 illustrated in FIG. 5 comprises the curved reversible element 2 which is formed into a U-shaped or C-shaped configuration having a pair of legs 2a and 2b. The pair of legs 2a and 2b have their respective proximal ends which are connected to each other by a base section 2c in an integral manner. Free ends of the respective legs 2a and 2b are connected to each other by a support element 7 whose both ends are mounted respectively to the free ends of the respective legs 2a and 2b through respective eyelets 8 and 8. The support element 7 is not covered with the gripping element 5 illustrated in FIG. 1, but has its outer surface which is relatively high in coefficient of friction. The support element 7 has its length shorter than that of the base section 2c of the curved reversible element 2. By the connection of the shorter support element 7 between the pair of legs 2a and 2b, the reversible performance is given to the curved reversible element 2.

The plurality of pectinate projections 3 have their respective proximal ends which are formed integrally with the base section 2c in equidistantly spaced relation to each other. In this case, no bulge is provided on the forward end of each of the pectinate projections 3.

Further, the hooking element 6B is formed separately from the curved reversible element 2, and is connected thereto by the eyelet 4a for angular movement thereabout.

SECOND MODIFICATION OF FIRST EMBODIMENT

Figure 6:
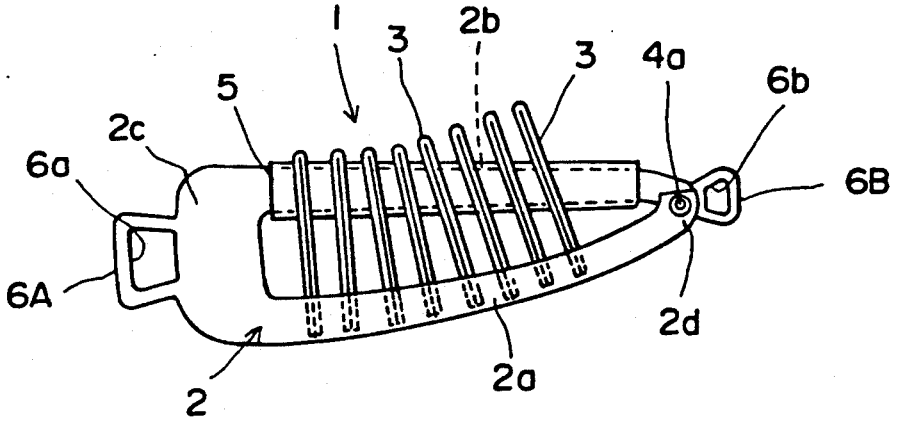
FIG. 6 is a view similar to the FIG. 1, but showing a second modification of the first embodiment illustrated in FIG. 1.

Alternatively, as shown in FIG. 6, the pectinate projections 3 may be formed in the following manner. That is, the proximal ends of the respective wires are fusibly deposited on a rear side of one of the pair of legs 2a of the curved reversible element 2 in equidistantly spaced relation to each other. Intermediate sections of the respective wires extend between the pair of legs 2a and 2b and are induced out of a space between the pair of legs 2a and 2b. The forward ends of the respective wires extend beyond the other leg 2b of the curved reversible element 2. In this case, each of the pectinate projections 3 is formed by a wire which is bent into a U-shaped configuration. The U-shaped wire has a proximal end which is fusibly deposited on the rear surface of the one leg 2a of the curved reversible element 2. The forward end of the U-shaped wire is free and is located above the gripping element 5. Further, no bulge is provided on the forward end of the U-shaped wire. Moreover, the hooking element 6B is formed separately from the curved reversible element 2, and is connected thereto by the eyelet 4a for angular movement thereabout.

SECOND EMBODIMENT

Figure 7:
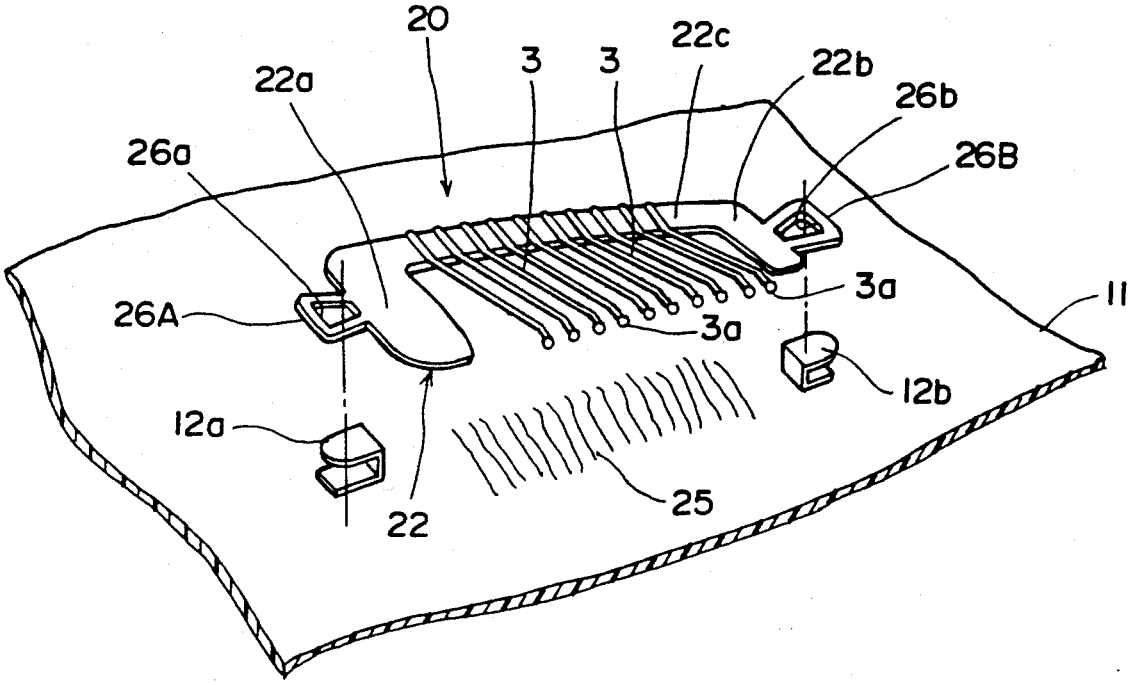
FIG. 7 is a fragmentary exploded perspective view of an anchoring member according to a second embodiment of the invention.

Referring next to FIG. 7, there is shown an anchoring member 20 according to a second embodiment of the invention. The anchoring member 20 comprises a curved reversible element 22 which is formed into a U-shaped or C-shaped configuration having a pair of legs 22a and 22b. The legs 22a and 22b are connected to each other by a base section 22c. The plurality of pectinate projections 3 have their respective proximal ends which are fusibly deposited onto an upper face of the base section 22c in equidistantly spaced relation to each other. Further, the pair of hooking sections 26A and 26B, which are formed therein respectively with hooking bores 26a and 26b, are provided, in an integral manner, respectively on the pair of legs 22a and 22b so as to project outwardly therefrom.

That is, the curved reversible element 22 has such a configuration that the leg 2b of the curved reversible element 2 of the first embodiment is dispensed with. The reversible performance is beforehand given to the curved reversible element 22 in a metallurgical manner or by a press machine.

A gripping area or arrangement 25 having, for example, a plurality of wrinkle-like ridgelines extending in spaced parallel relation to each other, is provided on the rear side or face of the wig base 11 which is made of a resinous material. In place of the wrinkle-like ridgelines, a plate element made of a resinous material may be attached to the rear face of the wig base 11. The plate element has its surface which is planar.

The anchoring member 20 constructed as described above is mounted to or dismounted from the wig base 11 in a manner substantially the same as that described with reference to the first embodiment. When the anchoring member 20 is mounted to the wig base 11, the pectinate projections 3 cooperate with the gripping arrangement 25 on the rear side of the wig base 11, to clamp therebetween the hairs on the user's head, for example.

THIRD EMBODIMENT

Figure 8:
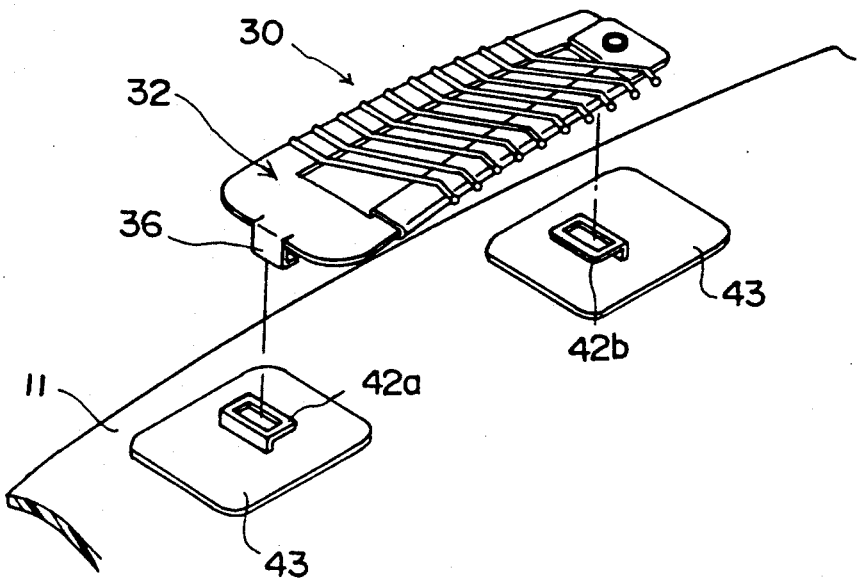
FIG. 8 is a view similar to FIG. 7, but showing an anchoring member according to a third embodiment of the invention.

As shown in FIG. 8 illustrating a third embodiment of the invention, the arrangement is such that an anchoring member 30 comprises a curved reversible element 32 which has a pair of hooking sections 36 (only one shown) formed respectively into hook configurations, and that the caught unit of the wig base 11 comprises a pair of caught bore elements 42a and 42b which are embedded respectively in a pair of adhesive holders 43 and 43. In this case, when the wig is worn on the user's head, the hooking sections 36 project in a direction opposite to the head skin. Thus, there is no such a fear that projections 36 injure the head skin. Further, it is preferable that there is no case where the hooking sections 36 are abutted against the user's head through the wig base 11 to give an unpleasant feeling to the user.

FOURTH EMBODIMENT

Figure 9:
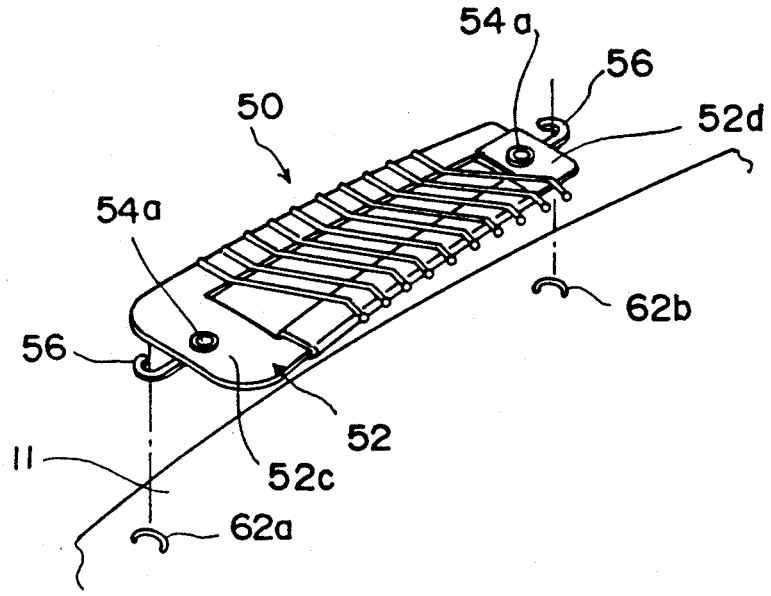
FIG. 9 is a view similar to FIG. 8, but showing an anchoring member according to a fourth embodiment of the invention.

FIG. 9 shows an anchoring member 50 according to a fourth embodiment of the invention. The hooking sections 36 illustrated in FIG. 8 project from the rear surface of the anchoring member 30 toward the inner surface of the wig base 11. To the contrary, the fourth embodiment illustrated in FIG. 9, a pair of hooking sections 56 and 56 on a curved reversible element 52 are formed respectively into hook-shaped configurations which are bent in a plane including the curved reversible element 52. The hooking sections 56 and 56 on the curved reversible element 52 project outwardly respectively from both longitudinal ends 52c and 52d of the curved reversible element 52. The hooking sections 56 and 56 on the curved reversible element 52 are mounted thereto respectively through a pair of pivoting elements or eyelets 54a and 54a. Each of the caught units on the inner surface of the wig base 11 includes a pair of spaced caught elements 62a and 62b. The caught elements 62a and 62b are formed respectively into loop configurations. The hooking sections 56 and 56 on the curved reversible element 52 are engaged respectively with the caught elements 62a and 62b on the inner surface of the wig base 11. In this case, there is obtained such a functional advantage that it is possible to form the anchoring member 50 so as to have its entire thickness which is smaller than that illustrated in FIG. 8.

Furthermore, each of the caught units on the inner surface of the wig base 11 should not be limited to the caught elements 62a and 62b which are separate from the wig base 11. For instance, the arrangement may be such that a plurality of pairs of rifts, gaps or the like (not shown) are formed in, for example, the artificial skin of the wig base, and the pair of hooking sections on the curved reversible element are inserted respectively in a corresponding pair of the rifts or gaps.

FIFTH EMBODIMENT

Figure 10:
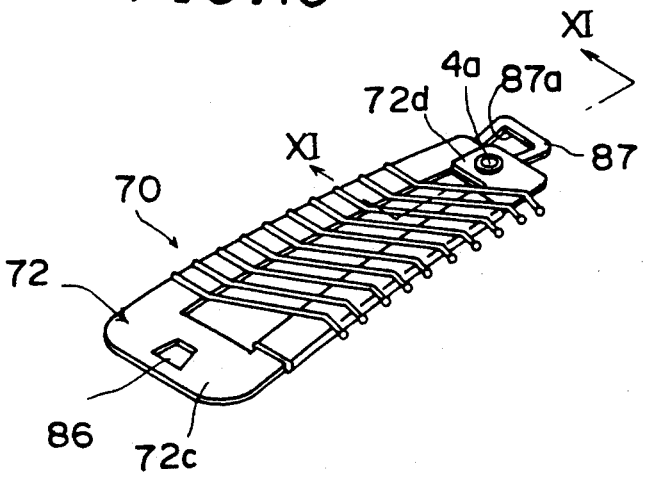
FIG. 10 is a perspective view of an anchoring member according to a fifth embodiment of the invention.

FIG. 10 shows an anchoring member 70 according to a fifth embodiment of the invention. The anchoring member 70 comprises a curved reversible element 72 which is provided, at its both longitudinal ends 72c and 72c, respectively with hooking sections 86 and 87. By the hooking sections 86 and 87, the anchoring member 70 is engaged with one of the caught units (not shown) on the inner surface of the wig base.

Figure 11:
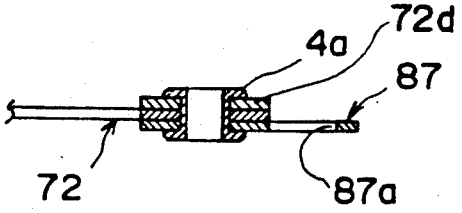
FIG. 11 is a fragmentary enlarged cross-sectional view taken along the line XI—XI in FIG. 10.

One of the hooking sections 86 is a bore directly formed in a wide surface of the longitudinal end 72c of the curved reversible element 72, while the other hooking section 87 is formed separately from the curved reversible element 72 and is formed therein with a bore 87a. Specifically, a shown in FIG. 11, the other hooking section 87 is formed by a thin plate element which is formed therein with the square O-shaped bore 87a and which projects outwardly from the longitudinal end 72d of the curved reversible element 72. That is, one of the hooking elements 86 and 87, which are provided respectively at the longitudinal ends 72c and 72d of the curved reversible element 72, is formed separately from the curved reversible element 72 and is mounted thereto for angular movement about the pivoting element of eyelet 4a. The hooking section 87 is mounted to the curved reversible element 72 through the eyelet 4a.

When the anchoring member 70 is mounted to the inner surface of the wig base, the hooking section or bore 86 of the anchoring member 70 is first engaged with one of the pair of caught elements of each of the caught units on the wig base, that is, with the caught element 12a in FIG. 1, for example. Subsequently, the hooking section 87 of the anchoring member 70 is moved angularly about the eyelet 4a with respect to the other caught element of the caught unit on the wig base, so that the horizontal position of the hooking section 87 is adjusted. Thus, the anchoring member 70 can be engaged with the inner surface of the wig base. Accordingly, when the anchoring member 70 is engaged with the caught unit on the wig base, the position of the anchoring member 70 is made easy. For instance, even if the pair of caught elements 12a and 12b, which cooperate with each other to form the caught unit on the wig base, are arranged in shift or deviation more or less in the horizontal direction, the hooking section 87 is moved angularly about the eyelet 4a, whereby it is possible to easily mount the anchoring member 70 to the inner surface of the wig base.

SIXTH EMBODIMENT

Figure 12:
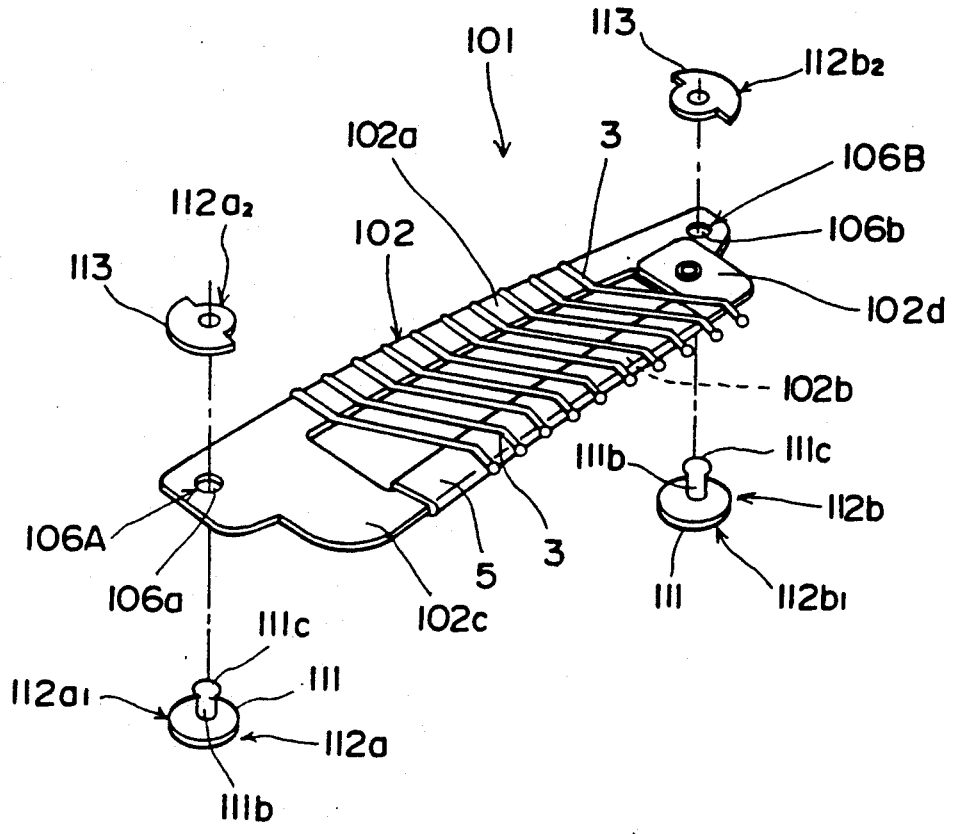
FIG. 12 is a view similar to FIG. 10, but showing an anchoring member according to a sixth embodiment of the invention.

Referring to FIG. 12, there is shown an anchoring member 101 according to a sixth embodiment of the invention. The anchoring member 101 comprises a curved reversible element 102 which has a pair of legs 102a and 102b similarly to the legs 2a and 2b in the first embodiment illustrated in FIGS. 1 through 4, and which has its both longitudinal ends 102c and 102d. A pair of hooking sections 106A and 106B are provided respectively at the longitudinal ends 102c and 102d of the curved reversible element 102.

One or a plurality of caught units are mounted on an inner surface of a head ornamental article such as a wig base or the like. The caught unit has a pair of caught elements 112a and 112b. The caught element 112a is composed of a pair of lower and upper caught sections $112a_1$ and $112a_2$, while the caught element 112b is composed of a pair of lower and upper caught sections $112b_1$ and $112b_2$. The upper caught sections $112a_2$ and $112b_2$ can be engageable respectively with the lower caught sections $112a_1$ and $112b_1$.

Figure 13:
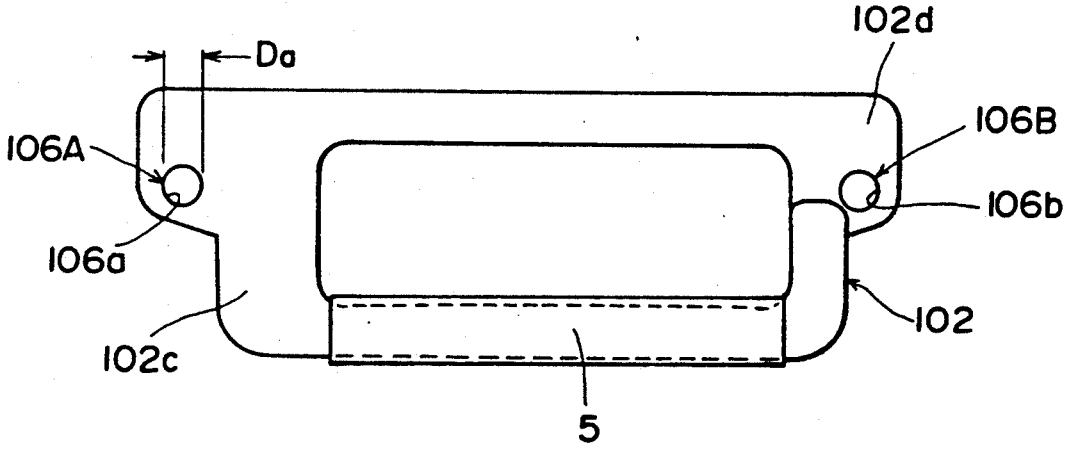
FIG. 13 is a top plan view of a curved reversible element illustrated in FIG. 12.

As shown in FIG. 13, the hooking sections 106A and 106B have their respective circular hooking bores 106a and 106b which are formed respectively in projecting portions of the longitudinal ends 102c and 102d, which project outwardly from the body of the curved reversible element 102. Each of the hooking bores 106a and 106b has its inner diameter $D_a$ which is 2.4 mm, for example.

Figure 14:
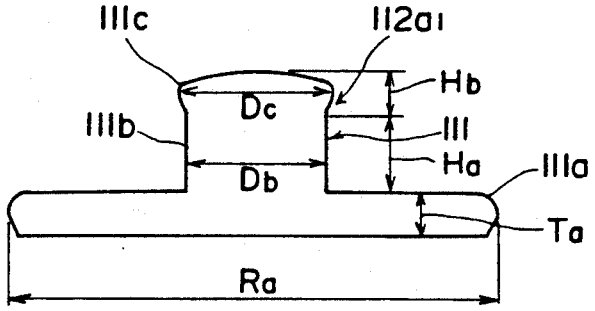
FIG. 14(A) is an enlarged side elevational view showing a lower one of a pair of caught sections of one of a pair of caught elements on an inner surface of a wig base of a wig, illustrated in FIG. 12.
FIG. 14(B) is a top plan view of the lower caught section illustrated in FIG. 14(A)
Figure 14:
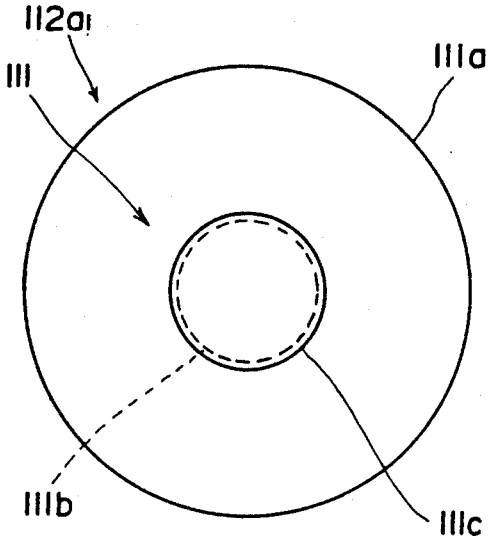

As shown in FIGS. 14(A) and 14(B), each of the lower caught sections (represented by the reference numeral $112a_1$) comprises a projecting element 111 which is formed with a base 111a in the form of a circular planar plate, a neck 111b provided on the base 111a in an upstanding manner, and a head 111c enlarged in diameter more than the neck 111b. These base 111a, neck 111b and head 111c are formed in an integral manner.

The projecting element 111 has its height which passes through the hooking bore 106a and which projects upwardly from the curved reversible element 102. Specifically, the projecting element 111 is formed into, for example, such a dimension that the neck 111b has its outer diameter $D_b$ which is 1.95 mm, the head 111c has its maximum outer diameter $D_c$ which is 2.2 mm, a height $H_a$ from the base 111a to the forward end of the neck 111b is 1.65 mm, and a height $H_b$ from the forward end of the neck 111b tot he forward end of the head 111e is 0.55 mm.

The base 111a is formed into, for example, such a dimension that a thickness $T_a$ is 0.65 mm, and an outer diameter $R_a$ is 6.9 mm.

As shown in FIG. 12, the upper caught sections $112a_2$ and $112b_2$ are engageable respectively with the projecting elements 111 and 111 which pass respectively through the hooking bores 106a and 106b and which project upwardly from the curved reversible element 102.

Figure 15:
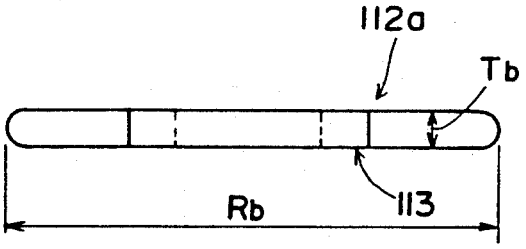
FIG. 15(A) is an enlarged side elevational view showing an upper one of the pair of caught sections of one of the pair of caught elements illustrated in FIG. 12.
FIG. 15(B) is a top view of the upper caught section illustrated in FIG. 15(A)
Figure 15:
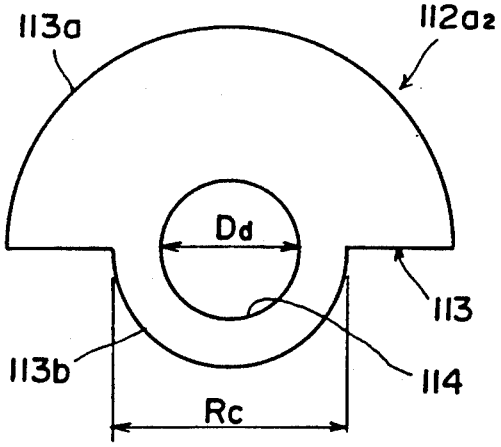

As shown in FIGS. 15(A) and 15(B), each of the upper caught sections (represented by the reference numeral $112a_2$) comprises an annular element 113. Specifically, the annular element 113 has such a configuration that a semi-circular portion 113*a* having its larger width faces toward a semi-circular portion 113*b* having its shorter width, and the semi-circular portions 113*a* and 113*b* are integrally connected to each other. The semi-circular portions 113*a* and 113*b* are common to each other in an inner diameter $D_d$ of a through bore 114 which is formed in the upper caught section $112a_2$. This configuration of the upper caught section 112i $a_2$ is convenient, because a cut-out formed in a part of the annular element 113 avoids abutment between the upper caught section $112a_2$ and the eyelet 4*a* provided at the longitudinal end 102*d* of the curved reversible element 102 when the annular element 13 is snap-fitted about the projecting element 111. Thus, it is ensured that the annular element 113 is snap-fitted about the projecting element 111.

The annular element 113 has, for example, such a dimension that the through bore 114 has its inner diameter $D_d$ which is 2.1 mm, the larger-width semi-circular portion 113*a* has its maximum outer diameter $R_b$ which is 6.9 mm, the smaller-width semi-circular portion 113*b* has its maximum outer diameter $R_c$ which is 3.55 mm, and a thickness $T_b$ is 0.8 mm.

That is, the maximum outer diameter $R_a$ of the base 111*a* of the projecting element 111 and the maximum outer diameter $R_b$ of the annular element 113 are so formed as to be the same as each other. Further, the outer diameter $D_b$ of the neck 111*b* and the outer diameter $D_c$ of the head 111*c* of the projecting element 111, and the inner diameter $D_d$ of the through bore 114 in the annular element 113 have the relationship of the neck $D_b$<the through bore $D_d$<the head $D_c$.

The projecting element 111 and the annular element 113 are made of an elastic material such as, for example, polyurethane or the like. The projecting element 111 and the annular element 113 cooperate with each other to form a snap coupling.

Figure 16:
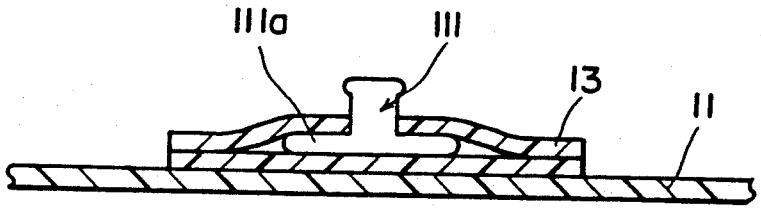
FIG. 16 is a fragmentary enlarged cross-sectional view of of the lower caught section illustrated in FIGS. 14(A) and 14(B), which is embedded in an adhesive holder on the wig base.

The projecting element 111 constructed as described above is mounted to the head ornamental article such as the wig base or the like in the following manner. That is, as shown in FIG. 16, the adhesive holder 13 such as a laminate seal or the like made of, for example, polyurethane or the like is polymerized to the base 111*a* of the projecting element 111, and the adhesive holder 13 is bonded to and fixedly mounted to the inner surface of the wig base 11.

Specifically, as shown in FIG. 12, the projecting elements 111 and 111, which are fixedly mounted to the inner surface of the head ornamental article such as the wig base or the like, are inserted respectively through the hooking bores 106*a* and 106*b* in the curved reversible element 102. The annular elements 113 and 113 are fitted respectively about the necks 111*b* and 111*b* which project upwardly from the curved reversible element 102. The annular elements 113 and 113 are engaged respectively with the heads 111*c* and 111*c* of the respective projecting elements 111 and 111 so as not to come out therefrom.

As described above, the sixth embodiment of the invention is constructed as follows. That is, the pair of hooking bores 106*a* and 106*b* are formed respectively in the longitudinal ends 102*c* and 102*d* of the curved reversible element 102. The projecting elements 111 and 111, which are provided on the inner surface of the head ornamental articles such as the wig base or the like, are easily inserted respectively through the hooking bores 106*a* and 106*b*. It is ensured that the curved reversible element 102 is mounted to the projecting elements 111 and 111 by the annular elements 113 and 113 from the above. By disengagement of the annular elements 113 and 113 from their respective projecting elements 111 and 111, the anchoring member 101 can extremely easily be demounted from the wig or the like and can be replaced by a new one.

Particularly, if the projecting elements 111 and 111 and the annular elements 113 and 113 are made of an elastic material as is in the sixth embodiment, there is no such a fear that the scalp of the wig user or the like is injured.

FIRST MODIFICATION OF SIXTH EMBODIMENT

Figure 17:
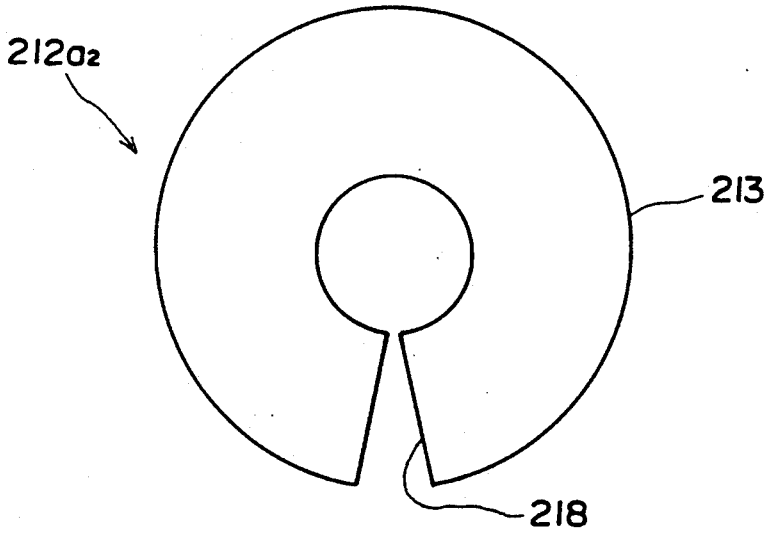
FIG. 17 is a view similar to FIG. 15(B), but showing a first modification of the upper caught section.

Referring to FIG. 17, there is shown an upper caught section $212a_2$ according to a first modification of the sixth embodiment illustrated in FIGS. 12 through 16. The upper caught section 212*a* comprises a substantially annular element 213 which is made of a rigid material. A cut-out 218 is formed at a part of the annular element 213 so that resiliency or elasticity is given to the annular element 213. It is possible for the annular element 213 to produce functional advantages which are similar to those described previously with reference to the sixth embodiment.

SECOND MODIFICATION OF SIXTH EMBODIMENT

Figure 18:
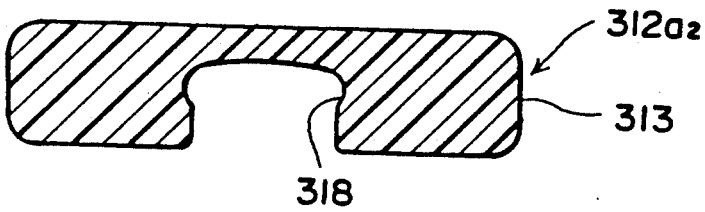
FIG. 18 is an enlarged ross-sectional view showing a second modification of the upper caught section.

Referring to FIG. 18, there is shown an upper caught section $312a_2$ according to a second modification of the sixth embodiment described with reference to FIGS. 12 through 16. The upper caught section 312*a* comprises a recess element 313.

As shown in FIG. 18, the recess element 313 is formed therein with a recess 318 so that the latter can be fitted about the head 111*c* of the projecting element 111 illustrated in FIGS. 14(A) and 14(B).

Basically or fundamentally, the recess element 313 has functional advantages similar to those of the annular element 113 of the sixth embodiment illustrated in FIGS. 12 through 16. In addition, such a reverse aspect may be considered that the recess element 313 is mounted to the inner surface of the wig base or the like, and the projecting element 111 illustrated in FIG. 12 is snap-fitted in the recess 318 of the recess element 313 from a location above the curved reversible element 102. Thus, the upper caught section 312*a* can be used widely or for various purposes.

THIRD MODIFICATION OF SIXTH EMBODIMENT

Figure 19:
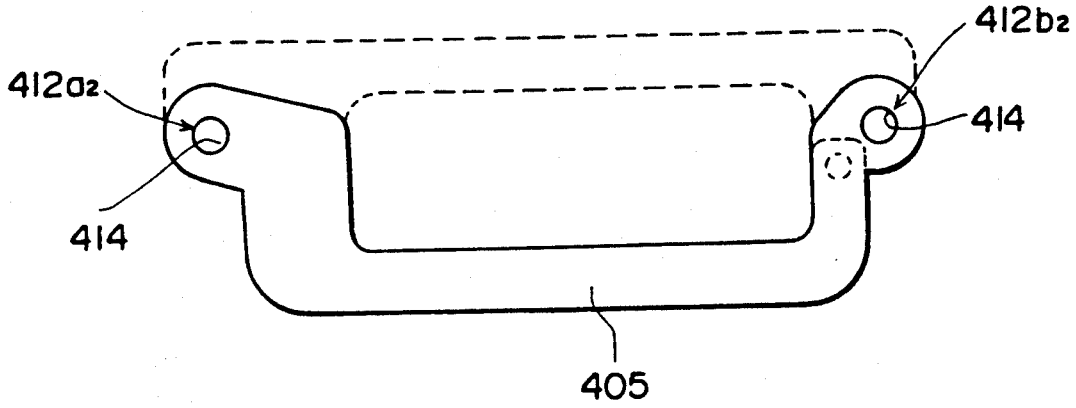
FIG. 19 is a top plan view of a modification of a gripping element illustrated in FIGS. 12 and 13.

Referring to FIG. 19, there is shown upper caught sections $412a_2$ and $412b_2$ according to a third modification of the sixth embodiment illustrated in FIGS. 12 through 16. The upper caught sections $412a_2$ and $412b_2$, which are formed therein respectively with the through bores 414 and 414, are formed integrally with a tube-like gripping element 405 with which the leg 102*b* of the curved reversible element 102 illustrated in FIG. 12 is covered in order to increase the coefficient of friction with respect to the pectinate projections 3 in FIG. 12.

The third modification illustrated in FIG. 19 can produce functional advantages similar to those described above and, in addition thereto, can produce such a superior functional advantage that the gripping element 405 is replaced with a new one together with the upper caught sections 412$a_2$ and 412$b_2$. Thus, a partial deterioration in quality of the upper caught sections 412$a_2$ and 412$b_2$ and shortening of the service life due to damage of the gripping element 405 can be prevented.

FIRST MODIFICATION OF CAUGHT ELEMENT

Figure 20:
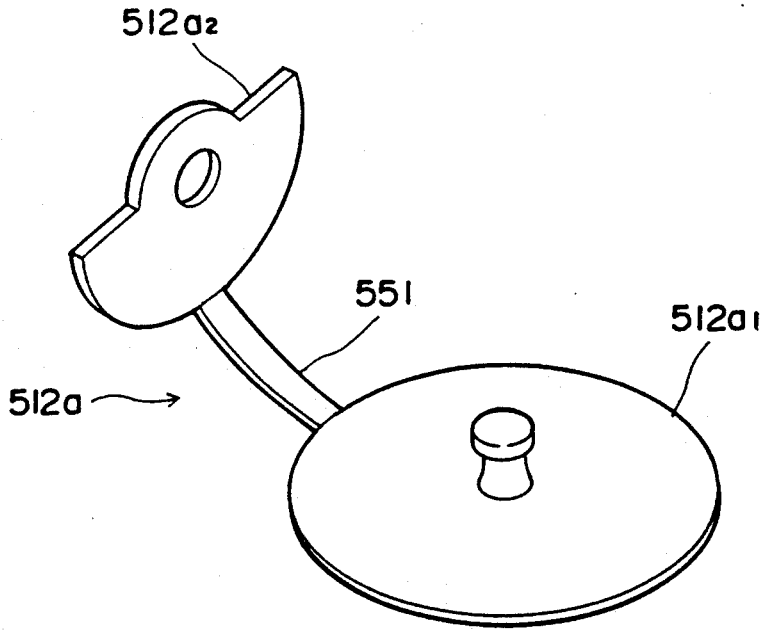
FIG. 20 is an enlarged perspective view of upper and lower caught sections of the caught element according to a modification of the sixth embodiment of the invention.

Referring to FIG. 20, there is shown a caught element 512*a* according to a first modification of the caught element 112*a* illustrated in FIGS. 14(A) through 15(B). The caught element 512*a* is composed of upper and lower caught sections 512$a_2$ and 512$a_1$. The larger-width semi-circular portion of the upper caught section 512$a_2$ and the base of the lower caught section 512$a_1$ are connected to each other through a strap 551 and are integrally formed together therewith. This caught element 512*a* is preferable, because it is possible to prevent missing or loss of the upper caught section 512$a_2$.

SECTION MODIFICATION OF CAUGHT ELEMENT

Figure 21:
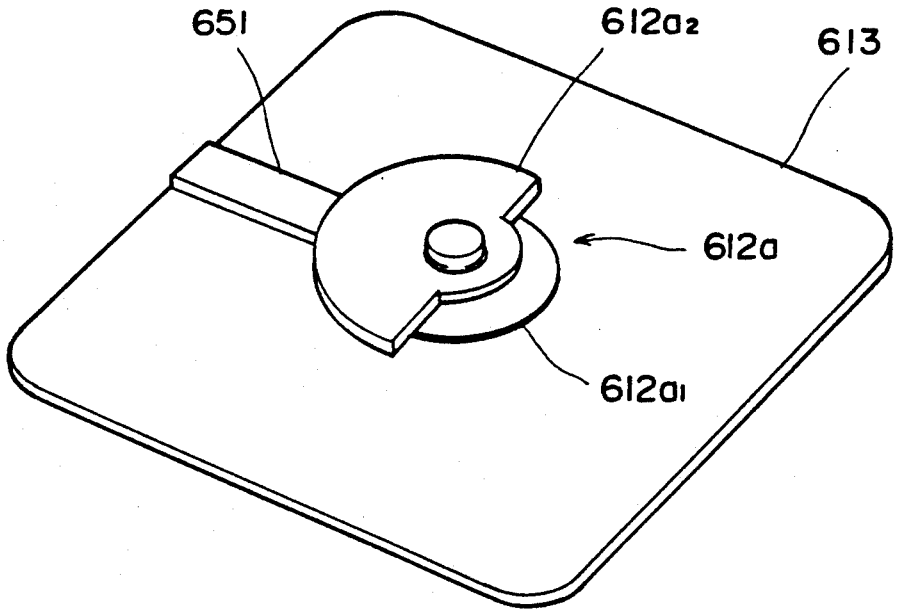
FIG. 21 is a view similar to FIG. 20, but showing upper and lower caught sections of the caught element according to another modification of the sixth embodiment of the invention.
Figure 22:
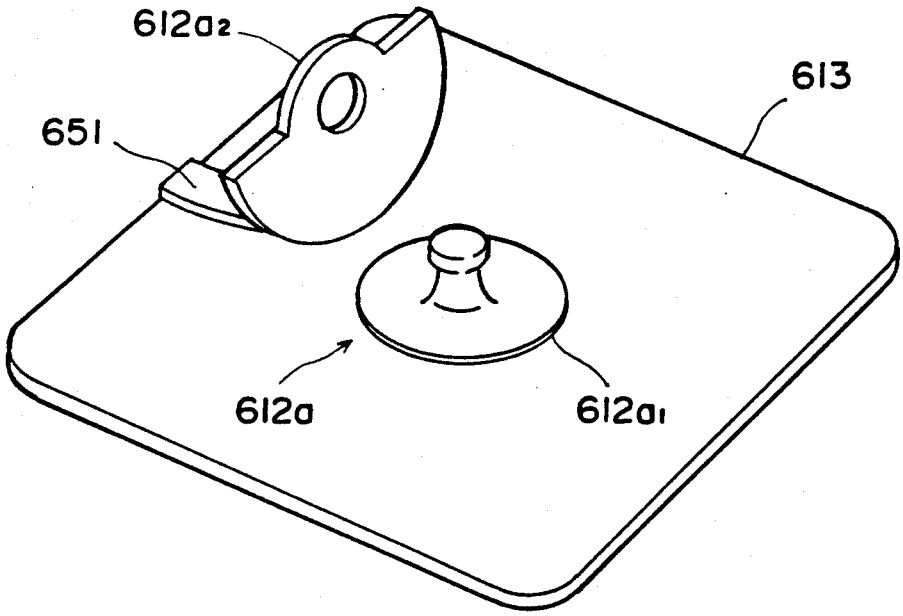
FIG. 22 is a view similar to FIG. 21, but showing the upper ad lower caught sections which are separated from each other.

Referring to FIGS. 21 and 22, there is shown a caught element 612*a* according to a second modification of the caught element 112*a* illustrated in FIGS. 14(A) through 15(B). The caught element 612*a* is composed of upper and lower caught sections 612$a_2$ and 612$a_1$. In the second modification, the lower caught section 612$a_1$ is bonded to an adhesive holder 613 by adhesives, and a strap 651 has one end thereof which is bonded to the holder 613 by adhesives. The other end of the strap 651 is integrally connected to the larger-width semi-circular portion of the upper caught section 612$a_2$. The second modification is also preferable, because it is possible to prevent missing or loss of the upper caught section 612$a_2$.

THIRD MODIFICATION OF CAUGHT ELEMENT

Figure 23:
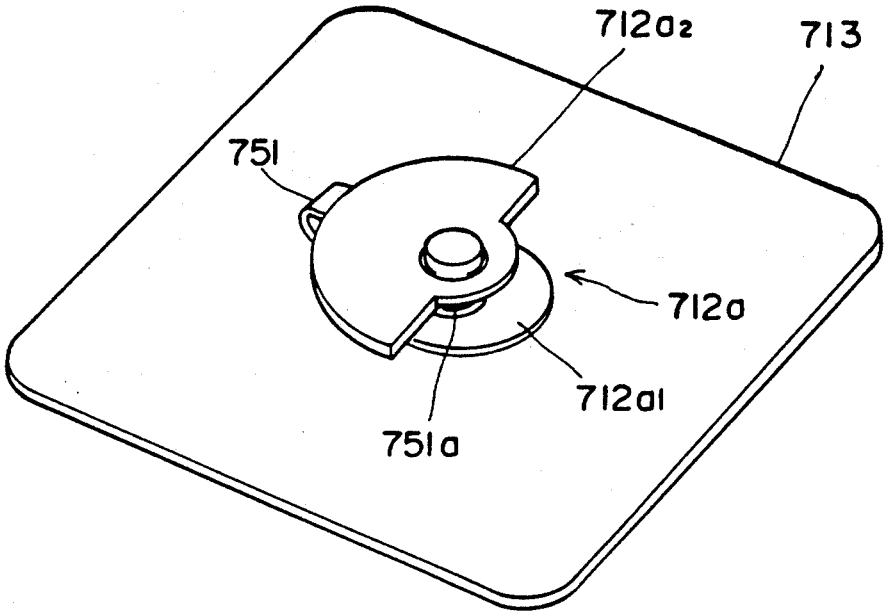
FIG. 23 is a view similar to FIG. 20, but showing upper and lower caught sections of the caught element according to still another modification of the six embodiment of the invention.
Figure 24:
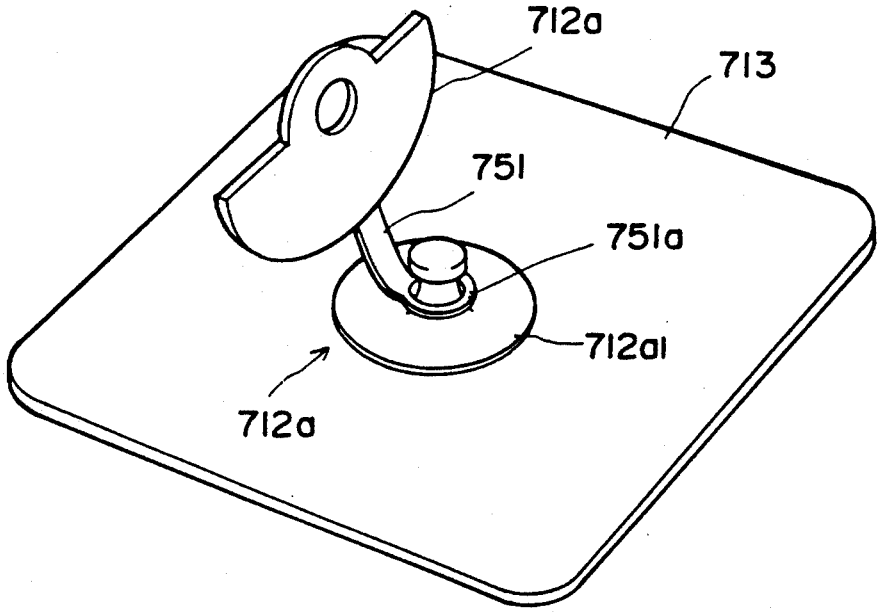
FIG. 24 is a view similar to FIG. 23, but showing the upper and lower caught sections which are separated from each other.

Referring to FIGS. 23 and 24, there is shown a caught element 712*a* according to a second modification of the caught element 112*a* illustrated in FIGS. 14(A) through 15(B). The caught element 712*a* is composed of upper and lower caught sections 712$a_2$ and 712$a_1$. In the third modification the lower caught section 712$a_2$ is bonded to an adhesive holder 713 by adhesive, similarly to the second modification of the caught element illustrated in FIGS. 21 and 22, and, a strap 751 is provided whose one end is integrally connected to the larger-width semi-circular portion of the upper caught section 712$a_2$. The other end of the strap 751 is provided with a ring section 751*a* which is fitted about the neck of the projection on the base of the lower caught section 712$a_1$. That is, the ring section 751*a* is snap-fitted about the neck of the projection on the base of the lower caught section 712$a_1$ so that the ring section 751*a* cannot easily come out from the neck through the head of the projection on the base of the lower caught section 712$a_1$. The third modification is also preferable, because it is possible to prevent missing or loss of the upper caught section 712$a_2$.

OTHER MODIFICATIONS

In connection with the above, the anchoring member according to the invention should not be limited to application only to the wig. It is hardly necessary to say that the anchoring member can be utilized in various head ornamental articles each of which is provided with at least one pair of caught elements capable of being engaged respectively with the hooking sections on the anchoring member. For instance, if the pair of caught elements 12*a* and 12*b* illustrated in FIG. 1 are formed on the inner or rear surface of a hair ornamental article which is made of a relatively thin metallic or plastic material having resiliency or elasticity, it is possible to easily mount, to the hair ornamental article, the anchoring member 1 having the hooking sections 6A and 6B, which are capable of being easily engaged with and disengaged from the caught elements 12*a* and 12*b*, respectively. Thus, even if the anchoring member 1 is broken, the anchoring member 1 should be replaced by a new one, so that the hair ornamental article is not rendered unusable.

Further, it is of course that the anchoring member according to the invention can also be applied as a fastener for clamping a sheet material such as a thin plate made of paper or a metallic or synthetic resinous material.

What is claimed is:

1. An anchoring member for a head ornamental article having an element for releasably engaging the anchoring member, characterized by comprising:

a curved reversible element having reversible performance;

a plurality of pectinate projections mounted to said curved reversible element in spaced relation to each other;

gripping means at least in part on said curved reversible element, said pectinate projections being capable of being engaged with and disengaged from said gripping means when said curved reversible element is reversed;

wherein engagement of said pectinate projections and said gripping means with each other at the time said curved reversible element is reversed enables said pectinate projections and said gripping means to cooperate with each other to clamp an anchoring means therebetween;

hooking means mounted to said curved reversible element and having structure for releasable engagement with the element on the head ornamental article so that said curved reversible element can be releasably fastened to the head ornamental article; and said curved reversible element having a pair of legs, said pectinate projections being made of a plurality of metallic wires having respective proximal ends, forward ends and intermediate sections therebetween, said proximal ends of the respective wires being connected to a rear side of one of said pair of legs of said curved reversible element in spaced relation to each other, said intermediate sections of the respective wires extending between said pair of legs and projecting out of the space between said pair of legs, said forward ends of the respective wires extending beyond the other leg of said curved reversible element.

2. The anchoring member according to claim 1, characterized in that said hooking means on said curved reversible element includes at least two hooking sections which are provided at an outer periphery of said curved reversible element, at least one of said hooking sections being movable angularly relatively to said curved reversible element about an axis extending perpendicular to said curved reversible element.

3. The anchoring member according to claim 1, characterized in that said gripping means is formed by a rubber tube, said other leg being covered with said rubber tube.

4. The anchoring member according to claim 1, characterized in that said curved reversible element is elongated in configuration and has opposite longitudinal ends, and said hooking means on said curved reversible element including at least two hooking sections which project outwardly respectively from the longitudinal ends of said curved reversible element.

5. The anchoring member according to claim 1, characterized in that said curved reversible element is elongated in configuration and has opposite longitudinal ends, said hooking means on said curved reversible element including at least two hooking sections respectively disposed at said longitudinal ends of said curved reversible element, said hooking sections being formed in integral relation to said curved reversible element.

6. The anchoring member according to claim 1, characterized in that said curved reversible element is elongated in configuration and has opposite longitudinal ends, said hooking means on said curved reversible element including at least two hooking sections respectively disposed at said longitudinal ends of said curved reversible element, one of said hooking sections of said curved reversible element being a bore formed in one of said longitudinal ends of said curved reversible element, while the other hooking section is formed separately from said curved reversible element and is formed therein with a hooking bore.

7. An anchoring member for a head ornamental article having an element for releasably engaging the anchoring member, characterized by comprising:

a curved reversible element having a reversible performance;

a plurality of pectinate projections mounted to said curved reversible element in spaced relation to each other;

gripping means at least in part on said curved reversible element, said pectinate projections being capable of being engaged with and disengaged from said gripping means when said curved reversible element is reversed;

wherein engagement of said pectinate projections and said gripping means with each other at the time said curved reversible element is reversed enables said pectinate projections and said gripping means to cooperate with each other to clamp an anchoring means therebetween;

hooking means mounted to said curved reversible element and having structure for releasable engagement with the element on the head ornamental article so that said curved reversible element can be releasably fastened to the head ornamental article; and said curved reversible element being elongated in configuration and having opposite longitudinal ends, said hooking means on said curved reversible element including at least two hooking sections which project outwardly respectively from the longitudinal ends of said curved reversible element;

said hooking sections on said curved reversible element being formed respectively with hooking bores for releasable engagement with the anchoring means of the head ornamental article.

8. An anchoring member for a head ornamental article having an element for releasably engaging the anchoring member, characterized by comprising:

a curved reversible element having reversible performance;

a plurality of pectinate projections mounted to said curved reversible element in spaced relation to each other;

griping means at least in part on said curved reversible element, said pectinate projections being capable of being engaged with and disengaged from said gripping means when said curved reversible element is reversed;

wherein engagement of said pectinate projections and said gripping means with each other at the time said curved reversible element is reversed enables said pectinate projections and said gripping means to cooperate with each other to clamp an anchoring means therebetween;

hooking means mounted to said curved reversible element and having structure for releasable engagement with the element on the head ornamental article so that said curved reversible element can be releasably fastened to the head ornamental article;

said curved reversible element being elongated in configuration and having opposite longitudinal ends, said hooking means on said curved reversible element including at least two hooking sections provided respectively at said longitudinal ends of said curved reversible element, each said hooking sections on said curved reversible element being bent substantially into an L-shaped configuration.

9. The anchoring member according to claim 8, characterized in that said hooking sections on said curved reversible element being bent respectively into the L-shaped configurations whose respective legs are directed toward each other.

10. An anchoring member for a head ornamental article having an element for releasably engaging the anchoring member, characterized by comprising:

a curved reversible element having reversible performance;

a plurality of pectinate projections mounted to said curved reversible element in spaced relation to each other;

gripping means at least in part on said curved reversible element, said pectinate projections being capable of being engaged with and disengaged from said gripping means when said curved reversible element is reversed;

wherein engagement of said pectinate projections and said gripping means with each other at the time said curved reversible element is reversed enables said pectinate projections and said gripping means to cooperate with each other to clamp an anchoring means therebetween;

hooking means mounted to said curved reversible element and having structure for releasable engagement with the element on the head ornamental article so that said curved reversible element can be releasably fastened to the head ornamental article; and said curved reversible element being elongated in configuration and having opposite longitudinal ends, said hooking means on said curved reversible element including at least two hooking sections which project outwardly respectively from the longitudinal ends of said curved reversible element;

said hooking sections on said curved reversible element being formed respectively into hook-shaped configurations bent in a plane including said curved reversible element, said hooking sections on said curved reversible element being releasably engageable with the anchoring means on said head ornamental article.

11. The anchoring member according to claim 10, characterized by further including at least two pivoting elements, said hooking sections on said curved reversible element being mounted to said curved reversible element respectively through said pivoting elements.

12. The anchoring member according to claim 11, characterized in that each of said pivoting elements is an eyelet.

13. The anchoring member according to claim 10, characterized in that said curved reversible element has a pair of legs and a base section, said pair of legs having respective proximal ends connected to each other through said base section, said pectinate projections having respective proximal ends mounted to said base section of said curved reversible element, said pectinate projections having forward ends which extend toward a line through which forward ends of the respective legs are connected.

14. A wig characterized by comprising:

a wig base mainly composed of one of a net element and artificial skin;

a plurality of hairs planted to an outer surface of said wig base;

at least one anchoring member mounted to an inner surface of said wig base;

caught means fixedly mounted to the inner surface of said wig base at a location where said anchoring member is to be mounted to the inner surface of said wig base;

wherein said anchoring member comprises a curved reversible performance, a plurality of pectinate projections mounted to aid curved reversible element in spaced relation to each other, and hooking means mounted to said curved reversible element and capable of being engaged with said caught means on the inner surface of said wig base so that said curved reversible element can detachably be fastened to the inner surface of said wig base;

gripping means on one of said curved reversible elements and said wig base, said pectinate projections being capable of being engaged with and disengaged from said gripping means when said curved reversible element is reversed; and wherein engagement of said pectinate projections and said gripping means with each other at the time said curved reversible element is reversed when said wig is worn on a user's head enables said pectinate projections and said gripping means to cooperate with each other to clamp therebetween hairs on the user's head;

said caught means on the inner surface of said wig base including at least two spaced caught elements having their respective C-shaped cross-sectional configurations whose respective openings are directed away from each other.

15. The wig according to claim 14, characterized in that said hooking means on said curved reversible element has at least two spaced hooking sections, said hooking sections on said curved reversible element being formed respectively therein with hooking bores, and said caught elements having a spacing therebetween which is substantially identical with that between said hooking bores.

16. The wig according to claim 14, characterized by further including adhesive holder means adhered to the inner surface of said wig base, wherein said caught elements have their respective bottoms which are embedded in said adhesive holder means.

17. The wig according to claim 16, characterized in that said adhesive holder means is made of a resinous material.

18. A wig characterized by comprising:

a wig base mainly composed of a net element and/or an artificial skin;

a plurality of hairs planted to an outer surface of said wig base;

at least one anchoring member mounted to an inner surface of said wig base;

caught means fixedly mounted to the inner surface of said wig base at a location where said anchoring member is to be mounted to the inner surface of said wig base;

wherein said anchoring member comprises a curved reversible performance, a plurality of pectinate projections mounted to aid curved reversible element in spaced relation to each other, and hooking means mounted to said curved reversible element and capable of being engaged with said caught means on the inner surface of said wig base so that said curved reversible element can detachably be fastened to the inner surface of said wig base;

gripping means on one of said curved reversible elements and said wig base, said pectinate projections being capable of being engaged with and disengaged from said gripping means when said curved reversible element is reversed;

wherein engagement of said pectinate projections and said gripping means with each other at the time said curved reversible element is reversed when said wig is worn on a user's head enables said pectinate projections and said gripping means to cooperate with each other to clamp therebetween hairs on the user's head; and said curved reversible element being elongated in configuration having both longitudinal ends, that said hooking means on said curved reversible element includes at least two hooking sections, that said hooking sections have their respective hooking bores which are formed respectively in the longitudinal ends of said curved reversible element, that said caught means includes at least two lower caught sections and at least two upper caught sections, said lower caught sections being capable of being mounted to said wig base, said lower caught sections having their respective projecting elements having respective portions which extend respectively through said hooking bores and which project respectively from said hooking bores, said upper caught sections being engageable respectively with said portions of the respective projecting elements, which project respectively from said hooking bores, so that said curved reversible element is fixedly mounted to said wig base by said upper and lower caught sections in a detachable manner.

19. The wig according to claim 18, characterized in that each of said projecting elements has a base, a neck formed on said base in integral relation thereto and in an upstanding manner, and a head formed at an end of said neck remote from said base, said head being enlarged in diameter more than said neck, and each of said upper caught sections having an annular element which is fitted about the neck of a corresponding one of said projecting elements.

20. The wig according to claim 18, characterized in that each of said projecting elements has a base, a neck formed on said base in integral relation thereto and in an upstanding manner, and a head formed at an end of said neck remote from said base, said head being enlarged in diameter more than said neck, and each of said upper caught sections having a recess element which is fitted about the head of a corresponding one of said projecting elements.

21. The wig according to claim 18, characterized in that said upper caught sections provided respectively at the longitudinal ends of said curved reversible element are formed in integral relation to said gripping means.

22. The wig according to claim 18, characterized in that said projecting elements and said upper caught sections are made of an elastic material.

23. An anchoring member in combination with a head ornamental article, said article having an element for releasably engaging the anchoring member, characterized by comprising:

a curved reversible element having reversible performance;

a plurality of pectinate projections mounted to said curved reversible element in spaced relation to each other;

gripping means at least in part on said curved reversible element, said pectinate projections being capable of being engaged with and disengaged from said gripping means when said curved reversible element is reversed;

wherein engagement of said pectinate projections and said gripping means with each other at the time said curved reversible element is reversed enables said pectinate projections and said gripping means to cooperate with each other to clamp an anchoring means therebetween; and hooking means mounted to said curved reversible element and having structure for releasable engagement with the element on the head ornamental article so that said curved reversible element can be releasably fastened to the head ornamental article;

said curved reversible element having a pair of legs and a base section, said pair of legs having respective proximal ends connected to each other through said base section, said pectinate projections having respective proximal ends mounted to said base section of said curved reversible element, said pectinate projections having forward ends which extend toward a line through which forward ends of the respective legs are connected;

said gripping means being provided on said head ornamental article.

24. The anchoring member according to claim 23, characterized in that said curved reversible element is elongated in configuration and has opposite longitudinal ends, and said hooking means on said curved reversible element including at least two hooking sections which project outwardly respectively from the longitudinal ends of said curved reversible element.

25. The anchoring member according to claim 23, characterized in that said curved reversible element is elongated in configuration and has longitudinal ends, said hooking means on said curved reversible element including at least two hooking sections, said hooking sections having respective hooking bores formed respectively in the longitudinal ends of said curved reversible element, caught means including at least two lower caught sections and at least two upper caught sections, said lower caught sections being mounted to said head ornamental article, said lower caught sections having respective projection elements, said projecting elements having respective portions which extend respectively through said hooking bores and project respectively from said hooking bores, and said upper caught sections being engageable respectively with said portions of the respective projecting elements, which project respectively from said hooking bores, so that said curved reversible element is fixedly mounted to said head ornamental article by said upper and lower caught sections, in a detachable manner.

26. The anchoring member according to claim 25, characterized in that each of said projecting elements has a base, a neck formed on said base in integral relation thereto and in an upstanding manner, and a head formed at an end of said neck remote from said base, said head being enlarged in diameter more than said neck, each of said upper caught sections having an annular element fitted about the neck of a corresponding one of said projecting elements.

27. The anchoring member according to claim 25, characterized in that each of said projecting elements has a base, a neck formed on said base in integral relation thereto and in an upstanding manner, and a head formed at an end of said neck remote from said base, said head being enlarged in diameter more than said neck, each of said upper aught sections having a recess element fitted about the head of a corresponding one of said projecting elements.

28. The anchoring member according to claim 25, characterized in that said upper caught sections provided respectively at the longitudinal ends of said curved reversible element are formed in integral relation to said gripping means.

29. The anchoring member according to claim 25, characterized in that said projecting elements and said upper caught sections are made of an elastic material.

30. A wig characterized by comprising:

a wig base mainly composed of one of a net element, an artificial skin, and combination thereof;

a plurality of hairs planted to an outer surface of said wig base;

at least one anchoring member mounted to an inner surface of said wig base;

caught means fixedly mounted to the inner surface of said wig base at a location where said anchoring member is to be mounted to the inner surface of said wig base;

wherein said anchoring member comprises a curved reversible element having reversible performance, a plurality of pectinate projections mounted to said curved reversible element in spaced relation to each other, and hooking means mounted to said curved reversible element and capable of being engaged with said caught means on the inner surface of said wig base so that said curved reversible element can detachably be fastened to the inner surface of said wig base;

gripping means on one of said curved reversible element and said wig base, said pectinate projections being capable of being engaged with and disengaged from said gripping means when said curved reversible element is reversed;

wherein said engagement of said pectinate projections and said gripping means with each other at the time said curved reversible element is reversed when said wig is worn on a user's head enables said pectinate projections and said gripping means to cooperate with each other to clamp therebetween hairs on the user's head; and said caught means on the inner surface of said wig base including at least two spaced caught elements, each of said caught elements being bent substantially into an L-shaped configuration.

31. A wig characterized by comprising:

a wig base mainly composed of one of a net element, an artificial skin, and combinations thereof;

a plurality of hairs planted to an outer surface of said wig base;

at least one anchoring member mounted to an inner surface of said wig base;

caught means fixedly mounted to the inner surface of said wig base at a location where said anchoring member is to be mounted to the inner surface of said wig base;

wherein said anchoring member comprises a curved reversible element having reversible performance, a plurality of pectinate projections mounted to said curved reversible element in spaced relation to each other, and hooking means mounted to said curved reversible element and capable of being engaged with said caught means on the inner surface of said wig base so that said curved reversible element can detachably be fastened to the inner surface of said wig base;

gripping means on one of said curved reversible element and said wig base, said pectinate projections being capable of being engaged with and disengaged from said gripping means when said curved reversible element is reversed;

wherein said engagement of said pectinate projections and said gripping means with each other at the time said curved reversible element is reversed when said wig is worn on a user's head enables said pectinate projections and said gripping means to cooperate with each other to clamp therebetween hairs on the user's head; and said hooking means on said curved reversible element having at least two spaced hooking sections formed respectively into hook-shaped configurations which are bent in a plane including said curved reversible element, said caught means on the inner surface of said wig base including at least two spaced caught elements which are formed respectively into loop configurations, said hooking sections of said curved reversible element being engageable respectively with said caught elements on the inner surface of said wig base.

32. The wig according to claim 31, characterized in that said curved reversible element has a pair of legs and a base section, said pair of legs having their respective proximal ends which are connected to each other through said base section, said pectinate projections having respective proximal ends which are mounted to said base section of said curved reversible element, and said pectinate projections having their respective forward ends which extend toward a line through which forward ends of the respective legs are connected.

33. The wig according to claim 32, characterized in that said curved reversible element is elongated in configuration having both longitudinal ends, and said hooking means on said curved reversible element including at least two hooking sections which project outwardly respectively from the longitudinal ends of said curved reversible element.

34. The wig according to claim 32, characterized in that said gripping means is provided on said wig base.

35. The wig according to claim 34, characterized in that said gripping means includes a plurality of spaced wrinkle-like ridgelines extending substantially in parallel relation to said pair of legs of said curved reversible element.

* * * * *